US006435899B2

(12) United States Patent
Kojima

(10) Patent No.: US 6,435,899 B2
(45) Date of Patent: Aug. 20, 2002

(54) INSULATION-DISPLACEMENT TERMINAL FITTING AND PRODUCTION METHOD THEREFOR

(75) Inventor: Eiji Kojima, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/773,288

(22) Filed: Jan. 31, 2001

(30) Foreign Application Priority Data

Feb. 21, 2000 (JP) ..... 12-042892

(51) Int. Cl.[7] ..... H01R 4/24
(52) U.S. Cl. ..... 439/395; 439/397
(58) Field of Search ..... 439/395, 397, 439/399, 400, 401

(56) References Cited

U.S. PATENT DOCUMENTS

| | | | | |
|---|---|---|---|---|
| 3,902,154 A | * | 8/1975 | McKee | 439/401 |
| 4,040,702 A | * | 8/1977 | McKee et al. | 439/399 |
| 4,050,760 A | | 9/1977 | Cohen | 439/399 |
| 4,385,794 A | * | 5/1983 | Lucius | 439/399 |
| 4,940,425 A | * | 7/1990 | Hass et al. | 439/397 |
| 5,624,273 A | * | 4/1997 | Myer | 439/399 |

FOREIGN PATENT DOCUMENTS

| | | |
|---|---|---|
| EP | 0 251 556 | 1/1988 |
| EP | 0 722 197 | 1/1996 |
| EP | 1 058 342 | 12/2000 |

OTHER PUBLICATIONS

US 4,057,314, 11/1997, Mathe et al. (withdrawn)

* cited by examiner

*Primary Examiner*—Tulsidas Patel
(74) *Attorney, Agent, or Firm*—Anthony J. Casella; Gerald E. Hespos

(57) ABSTRACT

An insulation-displacement terminal fitting is provided to prevent cracks and/or splits during the formation of V-shaped blades in the side walls (11A) of the insulation-displacement terminal fitting. To achieve this objective, slits (15) are formed along boundaries between a bottom wall (13) and side walls (11A) at least in the forming range of the blades (11B), and a bent portion (16) is formed in the bottom wall (13) in the area of the slits (15). The blades (11B) in the side walls (11A) and the bent portion (16) in the bottom wall (13) are formed substantially simultaneously. Thus, neither the blades (11B) nor the side walls (11A) undergo an extensional deformation since base ends (11Ba) of the blades (11B) are brought closer to each other in the side walls (11A) and base ends (16*a*) of the bent portion (16) are brought closer to each other in the bottom wall (13).

12 Claims, 4 Drawing Sheets

INSULATION-DISPLACEMENT TERMINAL FITTING AND PRODUCTION METHOD THEREFOR

BACKGROUND OF THE INVENTION

1. Field of the Invention

The present invention relates to an insulation-displacement terminal fitting and to a method for producing an insulation-displacement terminal.

2. Description of the Related Art

A known insulation-displacement terminal fitting is disclosed in Japanese Unexamined Patent Publication No. 8241740. This terminal fitting has pairs of inwardly facing blades formed on opposed side walls. A wire can be pushed between the blades in each pair so that the blades cut a resin coating of the wire and contact a core of the wire. Each blade is V-shaped when viewed in a direction in which the wire is pushed, and is formed by bending a portion of the flat side wall into V-shape.

The blades of the prior art insulation-displacement terminal fitting are formed by embossing portions of the side walls into a V-shape. More particularly, the side walls are extended by placing a pressing jig at a position which becomes the apex of the V-shaped blade. Thus, the thickness of the blade becomes gradually thinner toward the apex. As a result, the apex of the blade may crack or split.

A crack or split may be avoided by embossing the side walls to a smaller degree, and thus widening a spacing between opposed blades, or by making the insulation-displacement terminal fitting of a relatively soft material. The former option cannot accommodate thin wires, while the latter option may cause a deformation and/or an insufficient contact pressure during insulation displacement. Neither option can solve the above problem.

In view of the above, an object of the present invention is to prevent cracks or splits in blades when side walls of an insulation-displacement terminal fitting are deformed to form blades.

SUMMARY OF THE INVENTION

The subject invention is directed to an insulation-displacement terminal fitting with a pair of side walls extending from a bottom wall. Portions of the side walls are bent to form at least one pair of blades, and a wire can be pressed at least partly between the blades for connection therewith. At least two slits are formed along boundaries between the bottom wall and the side walls and in areas that correspond at least to an entire forming area of the blades. According to a preferred embodiment, the blades are substantially V-shaped.

The insulation-displacement terminal fitting also includes a bent portion in the bottom wall and within a forming area of the slits.

The blades are formed by bending the side walls at the same time that the bent portion is formed in the bottom wall, but preferably after the slits are formed along the boundaries between the bottom wall and the side walls. The operation of forming the blades brings base ends of the blades closer to each other in the side walls. Simultaneously, an operation of forming the bent portion brings base ends of the bent portion closer to each other in the bottom wall. The shortening of the bottom wall due to the formation of the bent portion preferably is substantially equal to the shortening of the side walls due to the formation of the blades. Accordingly, neither the blades nor the bent portion undergo an extensional deformation and cracks and/or splits can be avoided.

The bent portion preferably is in a position on the bottom wall to contact an end portion of the wire. Thus an end face of a properly positioned wire contacts the bent portion without bending the wire. However an improperly positioned wire is bent upward by the bent portion.

The insulation-displacement terminal fitting may be inserted into a connector housing and locked by a retainer, and an end face of the wire mounted in a proper contact position may be in proximity to the retainer. However, the wire may be mounted in an improper contact position that is displaced toward the front of the terminal fitting from the proper contact position. In this situation, the retainer may interfere with the end of the wire, and may cause an assembling error if the insulation-displacement terminal fitting is mounted while being left displaced. However, in the present invention, the end of a wire that is mounted in an improper contact position interferes with the bent portion and is deformed, which enables detection of the wire in the improper contact position due to the deformation of the wire.

The invention also is directed to a production method for forming an insulation-displacement terminal fitting. The method comprises forming slits along an area between a bottom wall and a pair of side walls. The method then comprises bending portions of the side walls to form at least one pair of blades, such that a wire can be pressed at least partly between the blades and connected therewith. The blades preferably are formed to have substantially a V-shape.

The production method further comprises a step of forming a bent portion in the bottom wall for contacting a front portion of the wire. Preferably, the bent portion is formed within a forming area of the slits.

During the bending step of the blades, front and rear base ends of the respective blades are brought closer to each other in the side walls and simultaneously front and rear ends of the bent portion are brought closer to each other in the bottom wall. Additionally, a sum of the shortened distances between the base ends of the front and rear blades is substantially equal to a shortened distance between the base ends of the bent portion.

These and other objects, features and advantages of the present invention will become apparent upon reading of the following detailed description of preferred embodiments and accompanying drawings.

DETAILED DESCRIPTION OF THE PREFERRED EMBODIMENT

Insulation-displacement terminal fittings T of this embodiment preferably are produced from chained terminals A in which a carrier C connects substantially plate-shaped terminal blanks S. The terminal blanks S are stamped or cut into a specified shape, and the insulation-displacement terminal fittings T are formed by bending, deforming, embossing or configuring the terminal blanks S into a specified configuration. The insulation-displacement terminal fittings T are detached from the carrier C at appropriate stage in the manufacturing process, and eventually are inserted into a connector housing.

Figure 1:
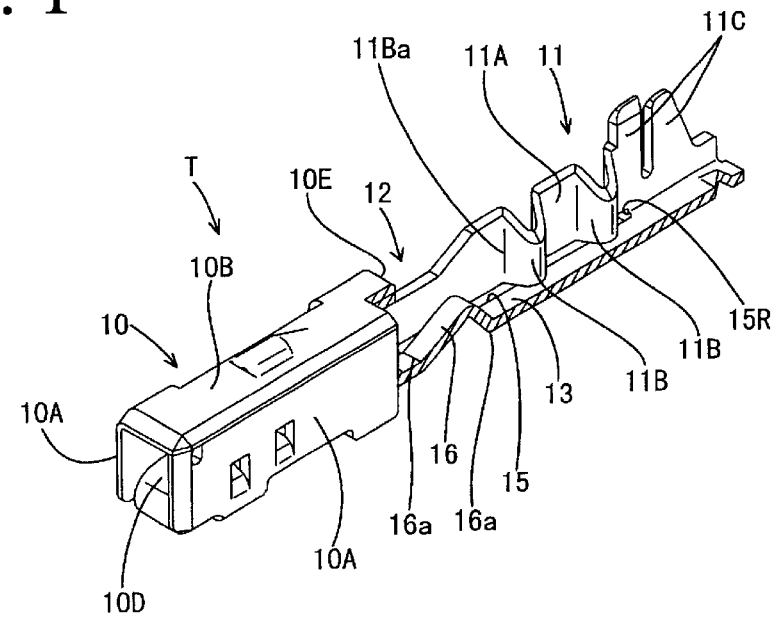
FIG. 1 is a perspective view partly cut away of an insulation-displacement terminal fitting according to one embodiment of the invention.
Figure 2:
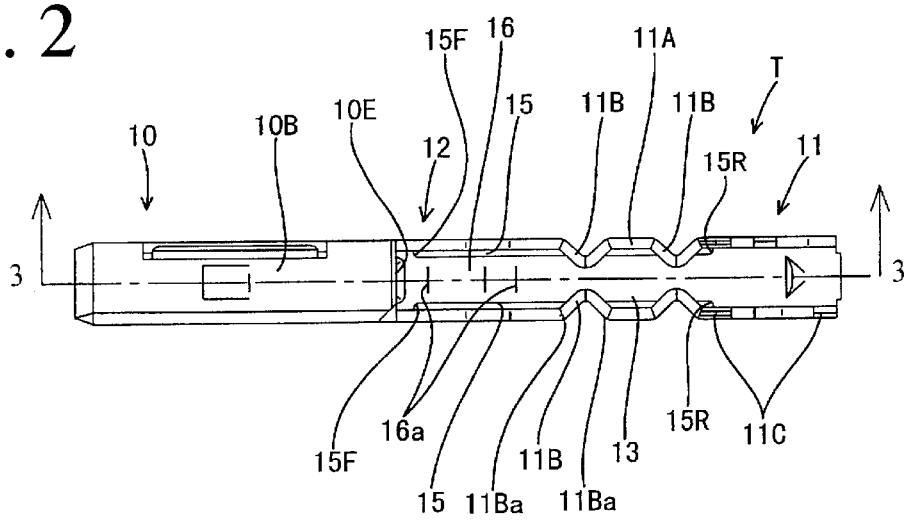
FIG. 2 is a plan view of the insulation-displacement terminal fitting.
Figure 3:
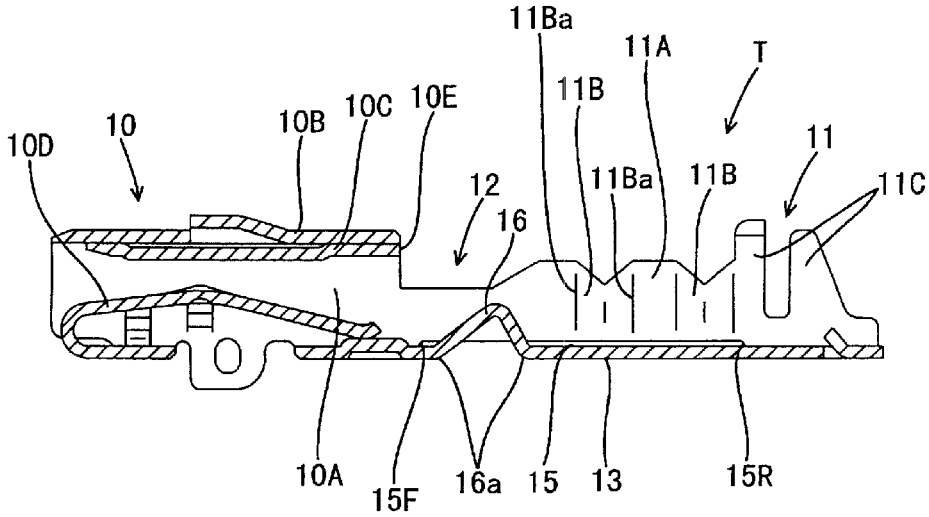
FIG. 3 is a section along line 3—3 in FIG. 2.
Figure 4:
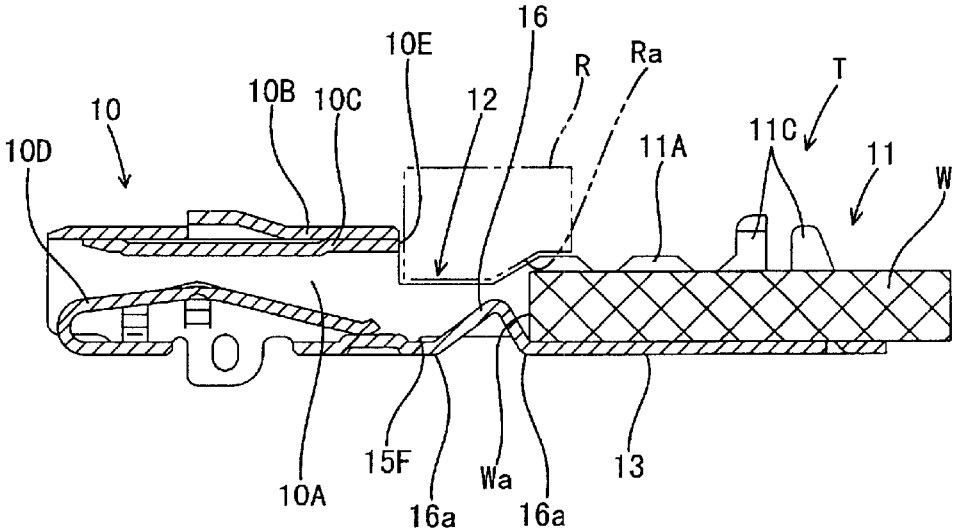
FIG. 4 is a section showing a state where a wire is mounted in a proper contact position.
Figure 5:
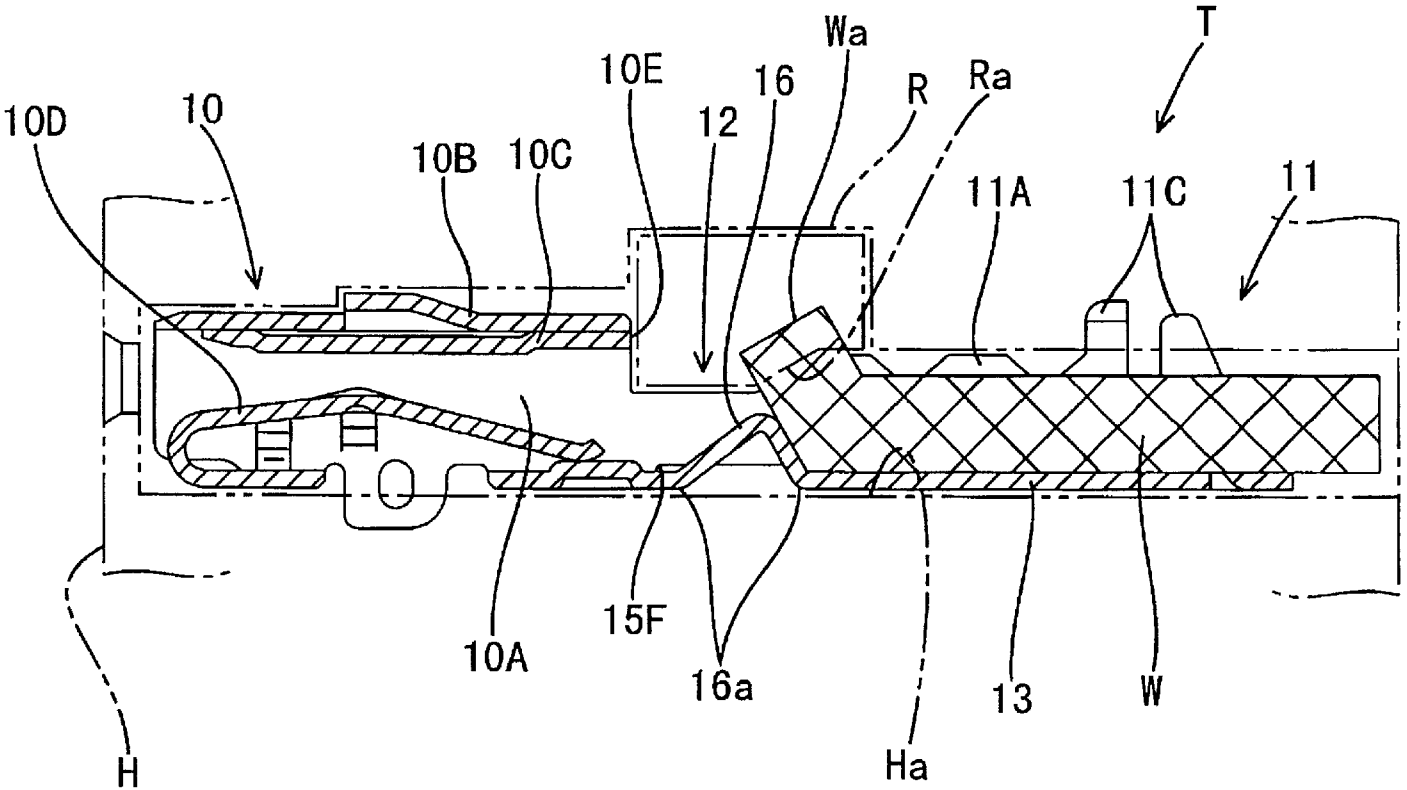
FIG. 5 is a section showing a state where the wire is mounted in an improper contact position.

It should be noted that left side in FIGS. 2 to 5 is referred to as front and vertical direction is based on the FIGS. 3 to 5 orientation.

The insulation-displacement terminal fitting T is substantially narrow along forward and backward or longitudinal directions and includes opposite front and rear ends. A connection portion 10 extends rearward from the front end of the terminal fitting T for connection with a mating male terminal fitting (not shown) and an insulation-displacement portion 11 extends forward from the rear end of the terminal fitting T for connection with a wire W. A coupling portion 12 of the terminal fitting T is between the connection portion 10 and the insulation-displacement portion 11. The connection portion 10, the insulation-displacement portion 11 and the coupling portion 12 are connected one after another in this order by a bottom wall 13.

The connection portion 10 has a substantially rectangular box-shape with open front and rear ends. More particularly, the connection portion 10 is comprised of the bottom wall 13, a pair of side walls 10A that extend from the opposite lateral sides of the bottom wall 13, and a pair of upper walls 10B, 10C that extend inwardly from the upper edges of the side walls 10A. The upper walls 10B, 10C are placed substantially one over the other, as shown in FIGS. 3–5. A substantially triangularly bent elastic contact piece 10D is formed e.g. by folding back a portion of the bottom wall 13 that extends from the front end of the connection portion 10. The folded portion of the bottom wall 13 is accommodated at least partly in the connection portion 10. The rear edges of the upper walls 10B, 10C serve as a locking portion 10E. The insulation-displacement terminal fitting T is inserted into a respective cavity Ha of a connector housing H from behind, and is locked there by engaging a retainer R with the locking portion 10E from behind, as shown in FIGS. 4 and 5.

The insulation-displacement portion 11 includes blades 11B formed by bending, embossing or deforming portions of a pair of side walls 11A that extend substantially normally upward from the opposite lateral edges of the bottom wall 13 into a substantially V-shape. The left and right blades 11B make a pair, and preferably two pairs of the blades 11B are provided one after the other or spaced along a longitudinal direction of the terminal fitting T in this embodiment. The wire W can be pushed at least partly between the pairs of blades 11B in the respective pair. A resin coating of the wire W is cut by the upper edges of the blades B during insulation-displacement, and the leading ends of the V-shaped blades 11B enter the cuts to contact a core of the wire W. Two crimping pieces 11C extend upward from the bottom wall 13 at a location behind the blades 11B. The crimping pieces 11C are crimped, bent or deformed into connection with the wire W held in contact with the blade portions 11B. It should be noted that the side walls 11A of the insulation-displacement portion 11 are substantially continuous with those of the coupling portion 12.

A continuous slit 15 is formed along a boundary between the bottom wall 13 and each side wall 11A over a range or length at least where the front and rear blades 11B are formed. A rear end 15R of the slit 15 is slightly behind a rear base end 11Ba of the rear blade 11B as seen along the longitudinal direction of the terminal fitting T. A front end 15F of the slit 15 is slightly behind the locking portion 10E and forward of the range where the blades 11B are formed.

A section of the bottom wall 13 of the coupling portion 12 is formed into a bent portion 16. The bent portion 16 is formed along forward and backward directions in a range where the slits 15 are formed. The bent portion 16 is located such that a front end face Wa of the wire W can be located at a base end 16*a* of the bent portion 16 when the wire W is in a proper contact position with the blades 11B along forward and backward directions (see FIG. 4). The wire W, while in this proper contact position, extends substantially straight and tangent with the bottom wall 13 up to the front end face Wa. In this proper state, the front end face Wa of the wire W is below the retainer R and substantially opposed to a slanted surface Ra of a bottom portion of the retainer R by a short distance although not interfering (see FIG. 4).

The wire W could be brought into contact with the blades 11B in an improper contact position forward from the proper contact position or toward the front of the terminal fitting T. In this event, a front end portion of the wire W is on the bent portion 16 an is curved upward, as shown in FIG. 5. Thus, the front end of the wire W is higher than when the wire W is brought properly into contact. Hence, the wire W may interfere with the retainer R. In other words, the front end of the wire W projects upward from the side wall in the improper contact state although the lower surface of the retainer R is higher than the upper edge of the side walls of the insulation-displacement portion 11. Thus, the retainer R and the wire W interfere with each other.

Figure 6:
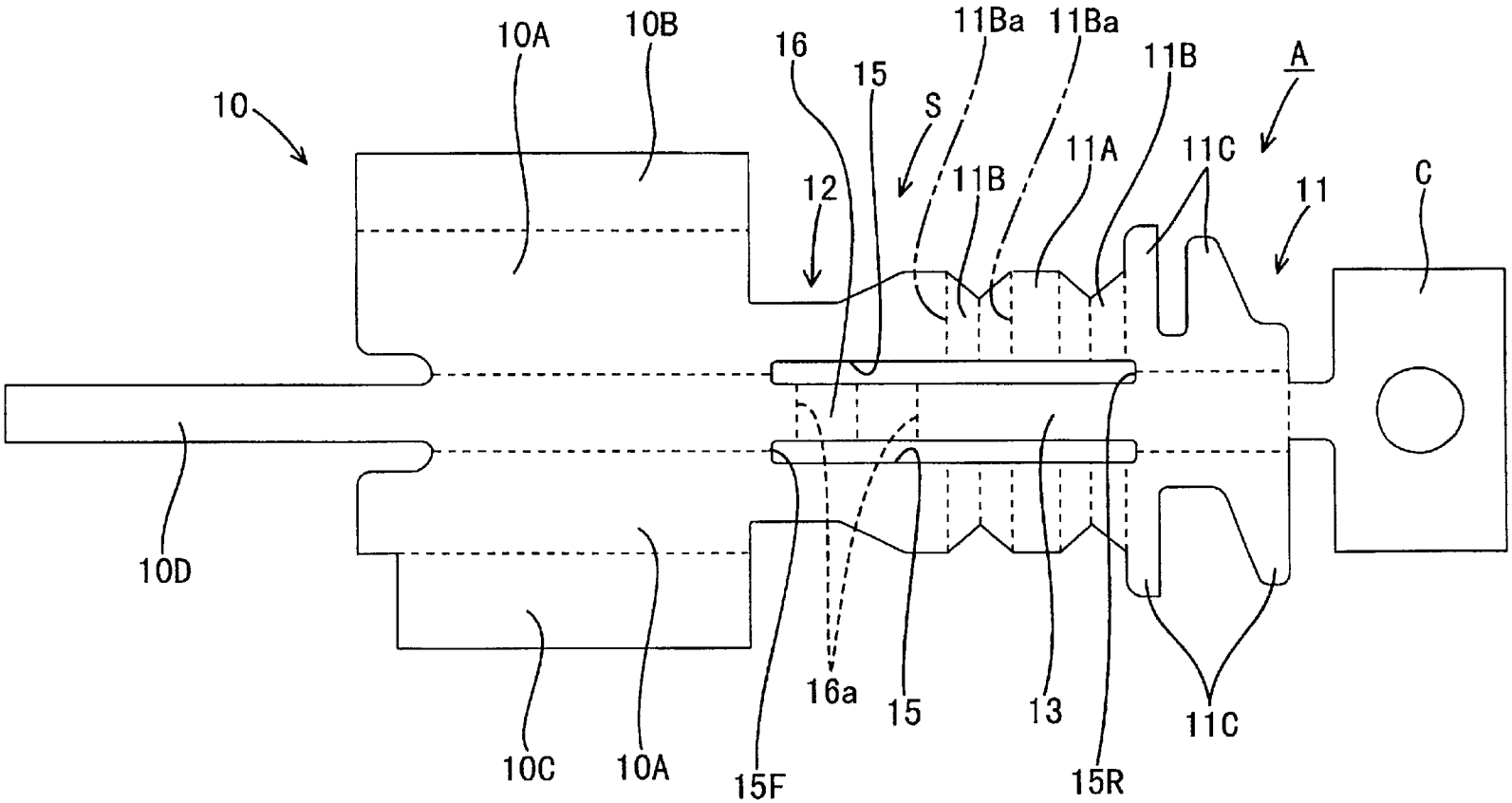
FIG. 6 is a development of the insulation-displacement terminal fitting.

The insulation-displacement terminal fitting T is produced by first separating the respective terminal blanks S from the carrier C in the chained terminals A and then the blanks S are bent along specified folds (no reference numerals are given, but shown in broken line in FIG. 6). At this time, the side walls 11A of the insulation-displacement portion 11 still are substantially flush or coplanar with the bottom wall 13, and the slits 15 already exist. The blades 11B then are formed by bending portions of the side walls 11A in V-shape and simultaneously the bottom wall 13 is bent into a substantially V-shape to form the bent portion 16. Alternatively, the bent portion 16 may be formed by cutting out a portion of the bottom wall 13 and bending such cut out portion upward or toward a wire arrangement space. During this bending or forming step, the front and rear base ends 11Ba of the respective blade 11B preferably are brought closer to each other in the side walls 11A and simultaneously front and rear ends 16*a* of the bent portion 16 are brought closer to each other in the bottom wall 13. A sum of the shortened distances between the base ends 11Ba of the front and rear blades 11B is substantially equal to a shortened distance between the base ends 16*a* of the bent portion 16. In other words, a shortened length of the bottom wall 13 and a shortened length of the side walls 11A between the front and rear ends 15F, 15R of the slits 15 during bending are substantially equal. Thus, neither the bottom wall 13, including the bent portion 16, nor the side walls 11A, including the blades 11B undergo an extensional deformation during bending.

Thereafter, the side walls 10A, 11A are bent at a substantially right angle to the bottom wall 13, and the elastic contact piece 10D and the connection portion 10 are formed. In this way, the insulation-displacement terminal fitting T is completely formed.

As described above, in this embodiment, the slits 15 are formed along the boundaries between the bottom wall 13 and the side walls 11A, and the bent portion 16 is formed in the bottom wall 13 during formation of the blades 11B. Accordingly, an operation of bringing the base ends 11Ba of the blades 11B closer to each other in the side walls 11A and an operation of bringing the base ends 16*a* of the bent portion 16 closer to each other in the bottom wall 13 are performed independently. Thus, distortions of the side walls 11A are taken up and neither the side walls 11A nor the blades 11B undergo an extensional deformation. Therefore, the blades 11B do not become thinner and cracks and/or splits in the blades 11B can be avoided.

If the wire W is mounted in a proper contact position in the insulation-displacement terminal fitting T, then the front end face Wa of the wire W will be spaced a short distance rearward of the slanted surface Ra at the bottom portion of the retainer R when the insulation-displacement terminal fitting T is mounted properly in the cavity Ha. Conversely, if the insulation-displacement terminal fitting T is inserted into the cavity Ha with the wire displaced forward from the proper contact position, the slanted surface Ra of the retainer R will interfere with the front end of the wire W. This interference will provide a clear indication of an assembling error.

The present invention is not limited to the above-described illustrated embodiment. For example, following embodiments are also embraced by the technical scope of the present invention. Besides them, various changes can be made without departing from the scope and spirit of the present invention.

Although the bent portion projects upward from the bottom wall in the foregoing embodiment, it may project downward (outward) from the bottom wall.

Although the bent portion has a triangular shape pointing upward in the foregoing embodiment, it may have a wavy, trapezoidal, arcuate or other shape according to the present invention.

What is claimed is:

1. An insulation-displacement terminal fitting with a bottom wall and first and second side walls extending from the bottom wall to define a wire receiving space between the first and second side walls, wherein:

first and second slits being formed along boundaries between the bottom wall and the respective first and second side walls;

first and second substantially V-shaped blades being formed on portions of the respective first and second side walls adjacent the respective first and second slits, said first and second V-shaped blades being substantially opposed to one another and projecting into the wire receiving space; and a bent portion formed in the bottom wall at a location aligned with said slits, the bent portion projecting into said wire receiving space at a location spaced from said blades.

2. An insulation-displacement terminal fitting according to claim 1, wherein the insulation-displacement terminal fitting has opposite front and rear ends, a connecting portion being formed adjacent said front end and being configured for mating with another terminal fitting, the bent portion being in a position on the bottom wall between the connecting portion and the blades, such that the bent portion contacts an end face of the wire when the wire is in a proper position without substantially bending the wire, while, when the wire is in an improper position, the wire is bent upward by the bent portion.

3. An insulation-displacement terminal fitting according to claim 1, wherein after bending a shortened length of the bottom wall and a shortened length of the side walls between front and rear ends of the slits are substantially the same.

4. An insulation-displacement terminal fitting according to claim 1, wherein the first and second blades define a first pair of blades, and wherein the first and second side walls are formed to further define a second pair of blades adjacent said slits and spaced from the first pair of blades and from the bent portion in the bottom wall.

5. A production method for forming an insulation-displacement terminal fitting having a bottom wall and two side walls extending from parallel boundaries of the bottom wall, comprising the following steps:

forming two substantial parallel slits along areas that will define the parallel boundaries between the bottom wall and the side walls, bending portions of the side walls to form at least one blade on each said side wall along sections of the respective side walls corresponding to the slits and simultaneously forming a bent portion in the bottom wall at a location corresponding to the slits and spaced from the blades, and bending the side walls relative to the bottom wall.

6. A production method according to claim 5, wherein the blades are formed to have substantially a V-shape.

7. A production method according to claim 5, wherein during the bending step of the blades, front and rear base ends of the respective blade are brought closer to each other in the side walls and simultaneously front and rear ends of the bent portion are brought closer to each other in the bottom wall, wherein a sum of the shortened distances of the space between the base ends of the front and rear blades is substantially equal to a shortened distance of a space between the base ends of the bent portion.

8. An insulation-displacement terminal fitting comprising a bottom wall, side walls extending upwardly from the bottom wall, slits being formed between the bottom wall and the respective side walls, at least one V-shaped blade being formed on portions of each said side wall adjacent one of said slits and a V-shaped bent portion being formed on said bottom wall between the slits and spaced from the blades, the blades and the bent portion being dimensioned to shorten the side walls and the bottom wall substantially equal amounts.

9. The insulation-displacement terminal fitting of claim 8, wherein the side walls are substantially normal to the bottom wall.

10. The insulation-displacement terminal fitting of claim 9, wherein the V-shaped blades each comprise panels that meet at a linear apex aligned substantially perpendicular to the bottom wall, and wherein the V-shaped bent portion comprises two panels that meet at a linear apex aligned substantially perpendicular to the respective side walls.

11. The insulation-displacement terminal fitting of claim 10, wherein the slits have opposed front and rear ends, the blades being between the bent portion and the rear ends of the respective slits.

12. The insulation-displacement terminal fitting of claim 8, wherein the V-shaped blades on each of the side walls are formed to project toward the V-shaped blades on the other of the side walls.

* * * * *